US008672214B2

(12) United States Patent
Manaige

(10) Patent No.: US 8,672,214 B2
(45) Date of Patent: Mar. 18, 2014

(54) CARTONS WITH RECLOSABLE OPENING FEATURES

(75) Inventor: Tim Manaige, Maplewood, MN (US)

(73) Assignee: Graphic Packaging International, Inc., Marietta, GA (US)

( * ) Notice: Subject to any disclaimer, the term of this patent is extended or adjusted under 35 U.S.C. 154(b) by 1706 days.

(21) Appl. No.: 11/586,294

(22) Filed: Oct. 25, 2006

(65) Prior Publication Data

US 2007/0095881 A1 May 3, 2007

Related U.S. Application Data

(60) Provisional application No. 60/731,103, filed on Oct. 28, 2005, provisional application No. 60/784,637, filed on Mar. 21, 2006.

(51) Int. Cl.

| | |
|---|---|
| ***B65D 5/54*** | (2006.01) |
| ***B65D 3/00*** | (2006.01) |
| ***B65D 5/56*** | (2006.01) |
| ***B65D 17/00*** | (2006.01) |

(52) U.S. Cl.
USPC ..... 229/101.2; 229/117.35; 229/230

(58) Field of Classification Search
USPC ..... 229/101.2, 117.35, 230
See application file for complete search history.

(56) References Cited

U.S. PATENT DOCUMENTS

| | | | | |
|---|---|---|---|---|
| 1,772,625 | A | 8/1930 | Caulfield | |
| 2,139,021 | A * | 12/1938 | Johnson | 229/101.2 |
| 2,192,722 | A | 3/1940 | Vogt | |
| 2,345,486 | A * | 3/1944 | Leebov | 229/101.2 |
| 2,355,665 | A | 8/1944 | Mabee | |
| 2,365,159 | A | 12/1944 | Walton et al. | |
| 2,396,310 | A | 3/1946 | Gibson | |
| 2,437,926 | A | 3/1948 | Ball | |
| 2,475,877 | A | 7/1949 | Ringler | |
| 2,509,289 | A | 5/1950 | Dunning | |
| 2,973,086 | A | 2/1961 | Thompson | |
| 3,021,002 | A | 2/1962 | Reynolds | |
| 3,033,362 | A | 5/1962 | Marcalus | |
| 3,133,688 | A | 5/1964 | Asman | |
| 3,355,089 | A | 11/1967 | Champlin | |
| 3,363,822 | A | 1/1968 | Maulini et al. | |

(Continued)

FOREIGN PATENT DOCUMENTS

| | | |
|---|---|---|
| DE | 29 23 455 A1 | 12/1980 |
| DE | 81 10 323.9 | 9/1981 |

(Continued)

OTHER PUBLICATIONS

Notice of Intent to Grant—Communication Under Rule 71(3) EPC dated Jun. 7, 2010, and text of granted patent for related European application No. 06826695.6.

*Primary Examiner* — Steven A. Reynolds
*Assistant Examiner* — Latrice Byrd
(74) *Attorney, Agent, or Firm* — Womble Carlyle Sandridge & Rice, LLP

(57) ABSTRACT

A carton includes a pivoting, reclosable lid that allows a top end of the carton to be accessed and subsequently closed. If a bag or other flexible vessel is accommodated within the carton, a first section of the lid can be pivoted toward a first side panel so that the vessel is pressed between the first lid section and the first side panel. The bag contents are thereby securely retained within the carton.

25 Claims, 15 Drawing Sheets

(56) References Cited

U.S. PATENT DOCUMENTS

| | | | | | |
|---|---|---|---|---|---|
| 3,426,955 | A | | 2/1969 | Olson | |
| 3,486,682 | A | | 12/1969 | Whipperman | |
| 3,669,345 | A | | 6/1972 | Cote | |
| 3,680,766 | A | | 8/1972 | Collura et al. | |
| 3,690,544 | A | | 9/1972 | Meyers | |
| 3,744,702 | A | | 7/1973 | Ellison | |
| 3,768,719 | A | | 10/1973 | Johnson | |
| 4,262,816 | A | | 4/1981 | Margulies | |
| 4,344,537 | A | | 8/1982 | Austin | |
| 4,484,683 | A | * | 11/1984 | Werner, Jr. | 229/101.2 |
| 4,508,218 | A | | 4/1985 | Focke et al. | |
| 4,512,476 | A | | 4/1985 | Herrington, Jr. | |
| 4,558,785 | A | | 12/1985 | Gordon | |
| 4,572,423 | A | | 2/1986 | Spencer | |
| 4,584,202 | A | | 4/1986 | Roccaforte | |
| 4,645,108 | A | | 2/1987 | Gavin et al. | |
| 4,676,394 | A | | 6/1987 | Hiersteiner | |
| 4,746,019 | A | | 5/1988 | Prater | |
| 4,863,052 | A | | 9/1989 | Lambert | |
| 4,905,898 | A | | 3/1990 | Wade | |
| 5,105,971 | A | | 4/1992 | Hertenstein et al. | |
| 5,265,799 | A | | 11/1993 | Stone | |
| 5,292,058 | A | | 3/1994 | Zoss et al. | |
| 5,347,865 | A | | 9/1994 | Mulry et al. | |
| 5,356,022 | A | | 10/1994 | Tipps | |
| 5,363,981 | A | | 11/1994 | Giblin et al. | |
| 5,427,267 | A | | 6/1995 | Willman | |
| 5,632,402 | A | | 5/1997 | Walsh et al. | |
| 5,632,404 | A | | 5/1997 | Walsh | |
| 5,746,871 | A | | 5/1998 | Walsh | |
| 5,783,030 | A | | 7/1998 | Walsh | |
| 5,794,811 | A | | 8/1998 | Walsh | |
| 5,794,812 | A | | 8/1998 | Walsh | |
| 5,857,614 | A | | 1/1999 | Walsh | |
| 5,918,799 | A | | 7/1999 | Walsh | |
| 5,960,555 | A | | 10/1999 | Deaton et al. | |
| 5,996,797 | A | | 12/1999 | Flaig | |
| 6,050,484 | A | | 4/2000 | Galomb | |
| 6,102,277 | A | | 8/2000 | Krapohl, Sr. | |
| 6,206,279 | B1 | | 3/2001 | Countee | |
| 6,352,096 | B1 | | 3/2002 | Walsh | |
| 6,364,202 | B1 | | 4/2002 | Zelley | |
| 6,419,151 | B1 | | 7/2002 | Urtubey | |
| 6,568,586 | B1 | | 5/2003 | VanEsley | |
| 6,761,269 | B2 | | 7/2004 | Hamming | |
| 6,854,639 | B2 | | 2/2005 | Walsh | |
| 7,025,504 | B2 | | 4/2006 | Olin | |
| 7,036,714 | B2 | | 5/2006 | Walsh et al. | |
| 7,210,612 | B2 | | 5/2007 | Walsh et al. | |
| 7,407,087 | B2 | * | 8/2008 | DeBusk et al. | 229/101.1 |
| 2002/0036153 | A1 | | 3/2002 | Yang | |
| 2002/0055429 | A1 | | 5/2002 | Walsh | |
| 2003/0144121 | A1 | | 7/2003 | Walsh et al. | |
| 2004/0007614 | A1 | | 1/2004 | Saulas | |
| 2004/0226989 | A1 | | 11/2004 | Cook et al. | |
| 2005/0109827 | A1 | | 5/2005 | Martin | |
| 2005/0127150 | A1 | | 6/2005 | Walsh et al. | |
| 2005/0187087 | A1 | | 8/2005 | Walsh | |
| 2005/0274782 | A1 | | 12/2005 | Petrelli et al. | |
| 2006/0049067 | A1 | | 3/2006 | McDonald | |
| 2006/0054675 | A1 | | 3/2006 | Bennett | |
| 2006/0243783 | A1 | | 11/2006 | Spivey, Sr. et al. | |
| 2006/0255105 | A1 | * | 11/2006 | Sweet | 229/101.2 |
| 2006/0255107 | A1 | * | 11/2006 | Wright | 229/101.2 |
| 2006/0266810 | A1 | | 11/2006 | Foushee | |

FOREIGN PATENT DOCUMENTS

| | | | |
|---|---|---|---|
| DE | 87 08 078.8 | | 10/1987 |
| DE | 94 13 813 | U1 | 10/1994 |
| EP | 1 457 425 | A1 | 9/2004 |
| FR | 2 699 150 | | 6/1994 |
| FR | 2 755 670 | | 5/1998 |
| GB | 104445 | | 3/1917 |
| GB | 1 242 356 | | 8/1971 |
| GB | 1 489 963 | | 10/1977 |
| GB | 1 584 066 | | 2/1981 |
| GB | 2 363 372 | A | 12/2001 |
| JP | 55 176119 | | 6/1954 |
| JP | 3 17033 | | 2/1991 |
| WO | WO 95/28325 | | 10/1995 |
| WO | WO 2006/133401 | A2 | 12/2006 |

* cited by examiner

CARTONS WITH RECLOSABLE OPENING FEATURES

PRIORITY APPLICATIONS

This application claims the benefit of U.S. Provisional Application No. 60/731,103, filed Oct. 28, 2005, and U.S. Provisional Application No. 60/784,637, filed Mar. 21, 2006, the entire contents of both documents being hereby incorporated by reference.

BACKGROUND

Conventional paperboard cartons are known. Such cartons often include a bag or other vessel held within the interior of the paperboard carton to accommodate the carton contents. The bag may be used to store foodstuffs or other dispensable products. Conventional paperboard cartons, however, may be difficult to open and/or close, and may not close reliably. Insufficiently closed bags may allow the carton contents to escape the carton or may expose the contents to insects or other environmental factors. Conventional paperboard cartons also occupy a volume that is determined by the amount of product held within the carton upon initial sale. When a portion of the product held within the carton is consumed, the carton continues to occupy a relatively large storage space, which may be limited, to store a reduced amount of product.

SUMMARY

According to a first embodiment, a carton comprises a first end panel, a first side panel, a second end panel, a second side panel, a top panel, and a bottom panel. A reclosable lid is defined in a top portion of the carton. The reclosable lid can be opened to allow access to the carton contents, and then closed by pivoting a first section of the carton lid toward the first side panel. If a flexible vessel, such as a bag for example, is accommodated within the carton, a top portion of the flexible vessel can be pressed between the first section and the first side panel to close off the carton contents. The first section may subsequently be pivoted away from the first side panel to reopen the carton, and reclosed when desired.

According to one aspect of the above-described embodiment, the reclosable lid may be repeatedly opened and reclosed, and provides ready access to the carton contents. When closed, the lid can secure the upper portion of the flexible vessel such that the carton contents remain securely retained in the vessel.

Also according to the first embodiment, the height of the carton is reduced after opening and closing. The carton contents are thereby stored in a carton that occupies less volume than the original carton.

Other aspects, features, and details of the present invention can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present embodiments are addressed to reclosable lids that allow the contents of cartons to be securely retained within the cartons. The cartons occupy a reduced volume after opening and reclosure. In this specification, the terms "top," "side," "end," and "bottom" are used for clarity of description only, and are not intended to limit the scope of the invention except as specifically recited in the appended claims.

Figure 1:
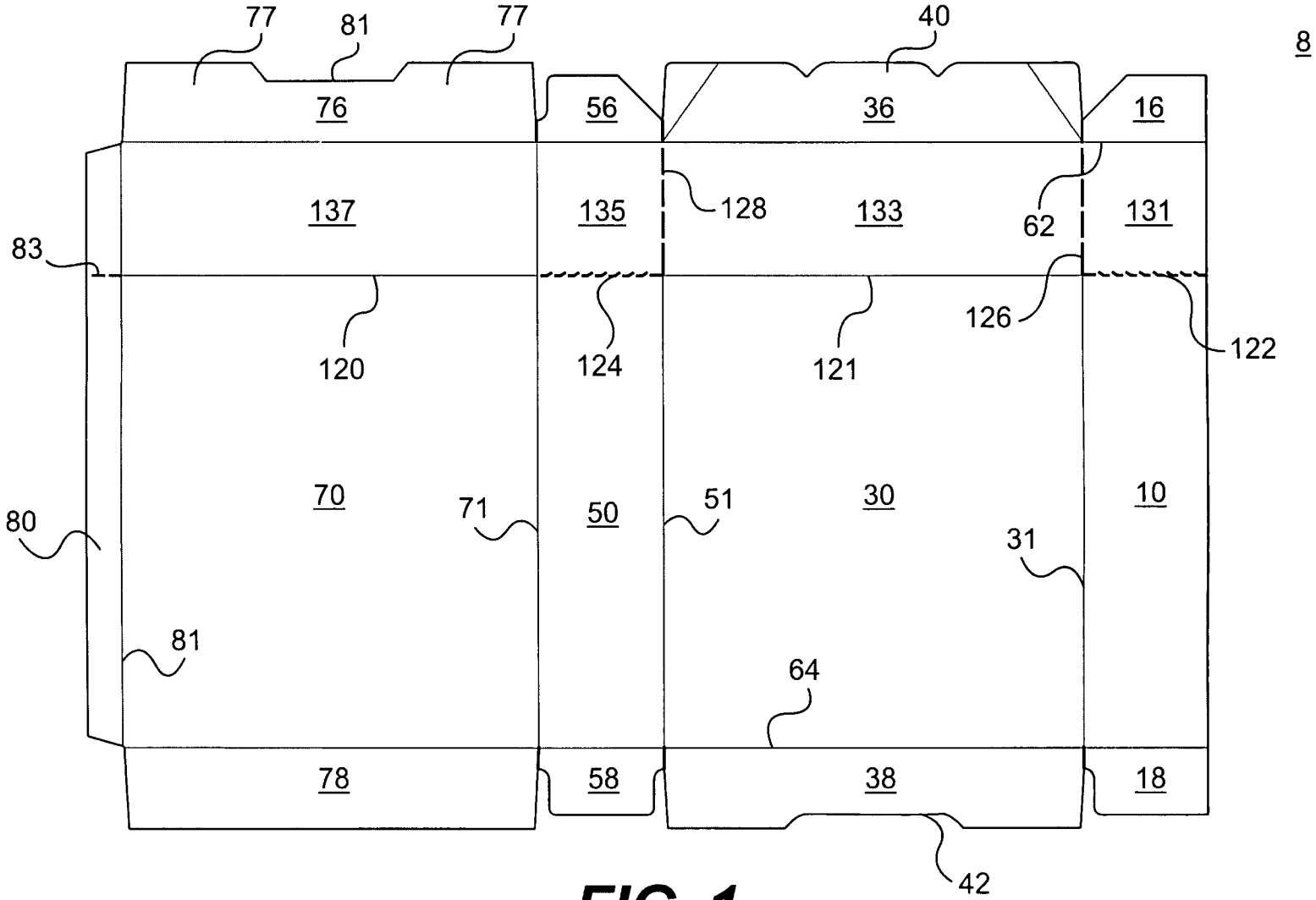
FIG. 1 is a plan view of a blank used to form a carton having a reclosable lid according to a first embodiment of the invention.

FIG. 1 is a plan view of a first, exterior side of a blank 8 used to form a carton 150 (illustrated in FIG. 2) having a reclosable lid 160 according to a first embodiment of the invention. The blank 8 comprises a first end panel 10 foldably connected to a first side panel 30 at a first transverse fold line 31, a second end panel 50 foldably connected to the first side panel 30 at a second transverse fold line 51, and a second side panel 70 foldably connected to the second end panel 50 at a third transverse fold line 71. An adhesive panel 80 may be foldably connected to the second side panel 70 at a fourth transverse fold line 81.

The first end panel 10 is foldably connected to a first end top flap 16 and a first end bottom flap 18. The first side panel 30 is foldably connected to a first side top flap 36 and a first side bottom flap 38. The second end panel 50 is foldably connected to a second end top flap 56 and a second end bottom flap 58. The second side panel 70 is foldably connected to a second side top flap 76 and a second side bottom flap 78. The top flaps 16, 36, 56, 76 extend along a first or top marginal area of the blank 8, and may be foldably connected along a first longitudinally extending fold line 62. The bottom flaps 18, 38, 58, 78 extend along a second or bottom marginal area of the blank 8, and may be foldably connected along a second longitudinally extending fold line 64.

The first and second longitudinal fold lines 62, 64 may be, for example, generally straight fold lines, or, the fold lines 62, 64 may be offset at one or more locations to account for, for example, blank thickness or other factors. When the carton 150 is erected, the top flaps 16, 36, 56, 76 close a top of the carton 150, and the bottom flaps 18, 38, 58, 78 close a bottom of the carton 150. The first side top flap 36 can optionally include, for example, a tab 40, and the second side top flap 76 may include a recess 81.

Longitudinally extending fold lines 120, 121 extend along the length of the blank 8. The longitudinal fold line 120 defines a bottom edge of a second side lid panel 137 in the second side panel 70, and the fold line 121 defines a bottom edge of a first side lid panel 133 in the first side panel 30. A first longitudinal tear line section 122 defines a bottom edge of a first end lid panel 131 in the first end panel 10, and a second longitudinal tear line section 124 defines a bottom edge of a second end lid panel 135 in the second end panel 50. The lines 120, 121, 122, 124 may be, for example, collinear or substantially collinear. Transversely extending corner tear lines 126, 128 may extend along the transverse fold lines 31, 51, respectively.

According to one exemplary method of construction, the carton 150 may be erected by applying glue to the adhesive panel 80 and folding the blank 8 flat about the transverse fold lines 31, 71 so that the exterior side of the adhesive panel 80 contacts the interior side of the first end panel 10. The first end panel 10 can be adhered to the adhesive panel 80 by, for example, glue, adhesives, or other means. The blank 8 may then be "opened" or "set up" to have a generally tubular shape. To close the top of the tubular carton form, the first and second end top flaps 16, 56 are folded inwardly, followed by the second side top flap 76, then the first side top flap 36. The underside of the first side top flap 36 is adhered to the exterior side of the second side top flap 76. The second side top flap 76 may be adhered to the first side top flap 36, for example, at two locations 77. Portions of the first and second side top flaps 36, 76 may also be adhered to the first and second end top flaps 16, 56. To close the bottom of the tubular carton form, the first and second end bottom flaps 18, 58 are folded inwardly, followed by the second side bottom flap 78, then the first side bottom flap 38. The underside of the first side bottom flap 38 is adhered to the exterior side of the second side bottom flap 78. Portions of the first and second side bottom flaps 38, 78 may also be adhered to the first and second end bottom flaps 18, 58. A bag 110 (shown in FIG. 4), for example, or other flexible vessel filled with product may be inserted in the carton 150 in a conventional manner at any time before closing the top and bottom of the carton. The product may be, for example, dispensable foodstuffs.

Figure 2:
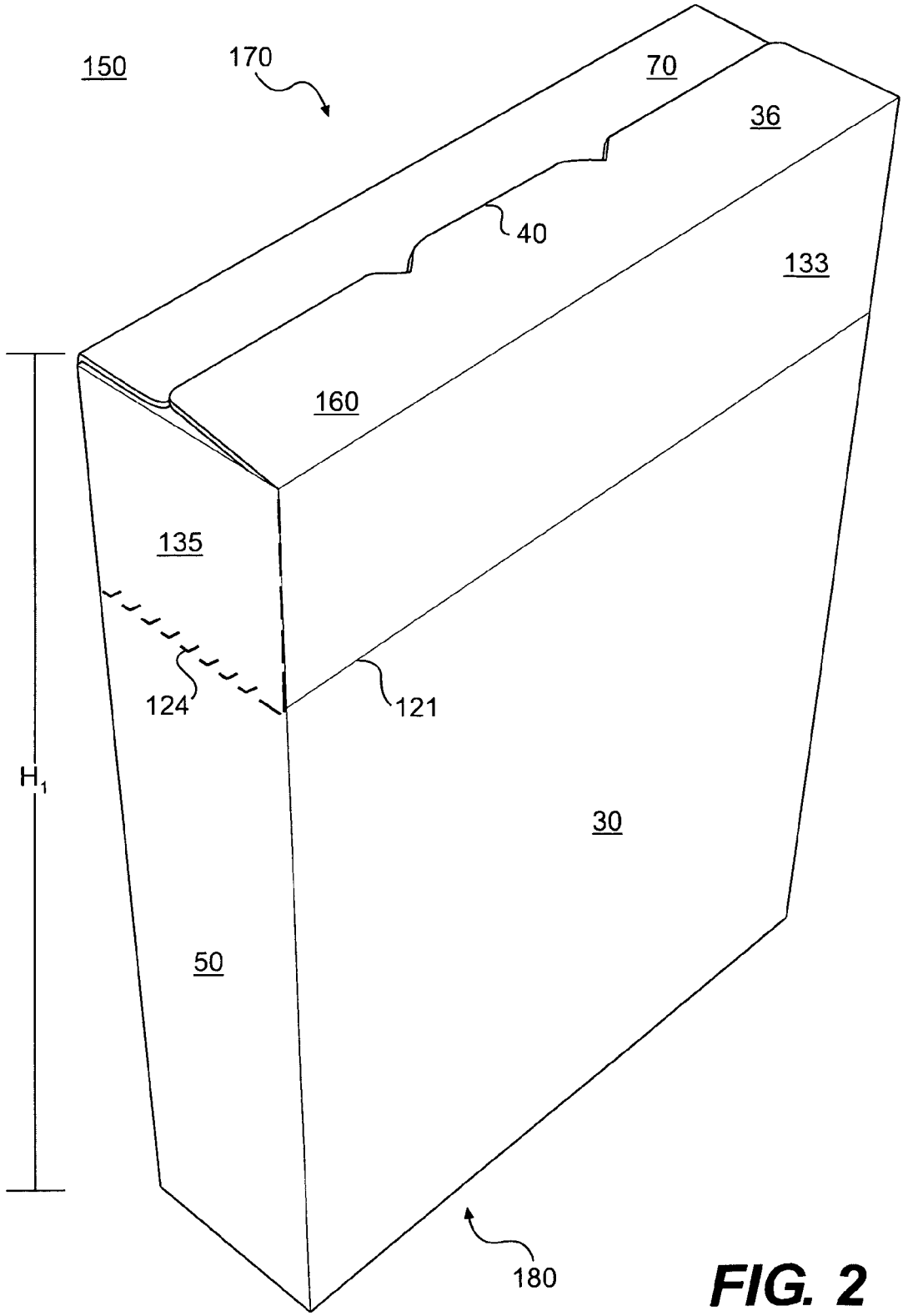
FIG. 2 illustrates the carton according to the first embodiment of the invention.
Figure 3:
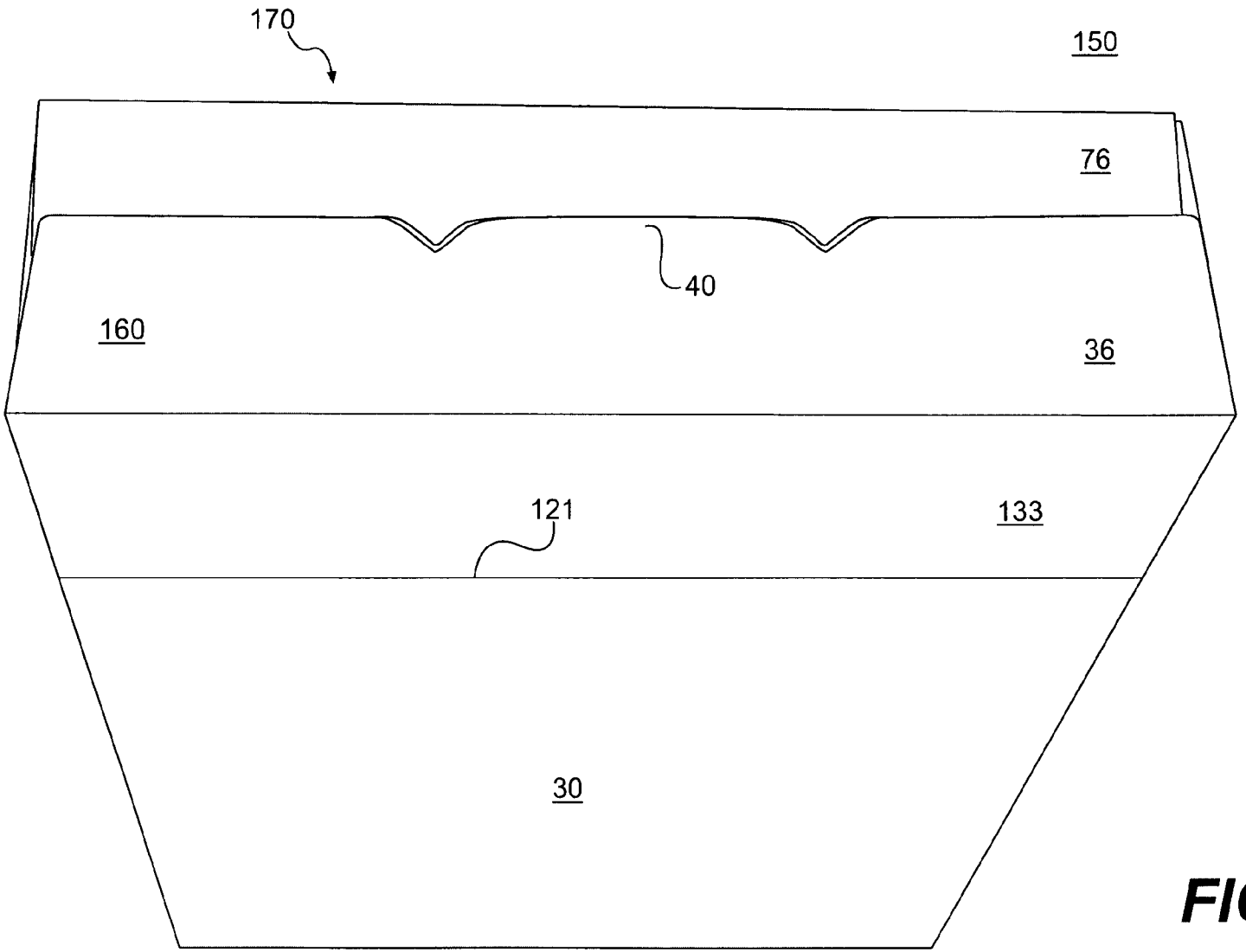
FIG. 3 is a top perspective view of the first carton embodiment.

FIGS. 2 and 3 illustrate the erected carton 150. In the erected carton 150, the top flaps 16, 36, 56, 76 form a top panel 170, and the bottom flaps 18, 38, 58, 78 form a bottom panel 180. The reclosable lid 160 is formed as the upper part of the carton 150, and comprises the lid panels 131, 133, 135, 137 extending around a periphery of the carton 150, and the top panel 170. The longitudinally extending folds line 120, 121 and the tear lines 122, 124 generally define a bottom edge of the lid 160. The carton 150 is generally parallelepipedal, and has an initial, unopened height $H_1$.

Figure 4:
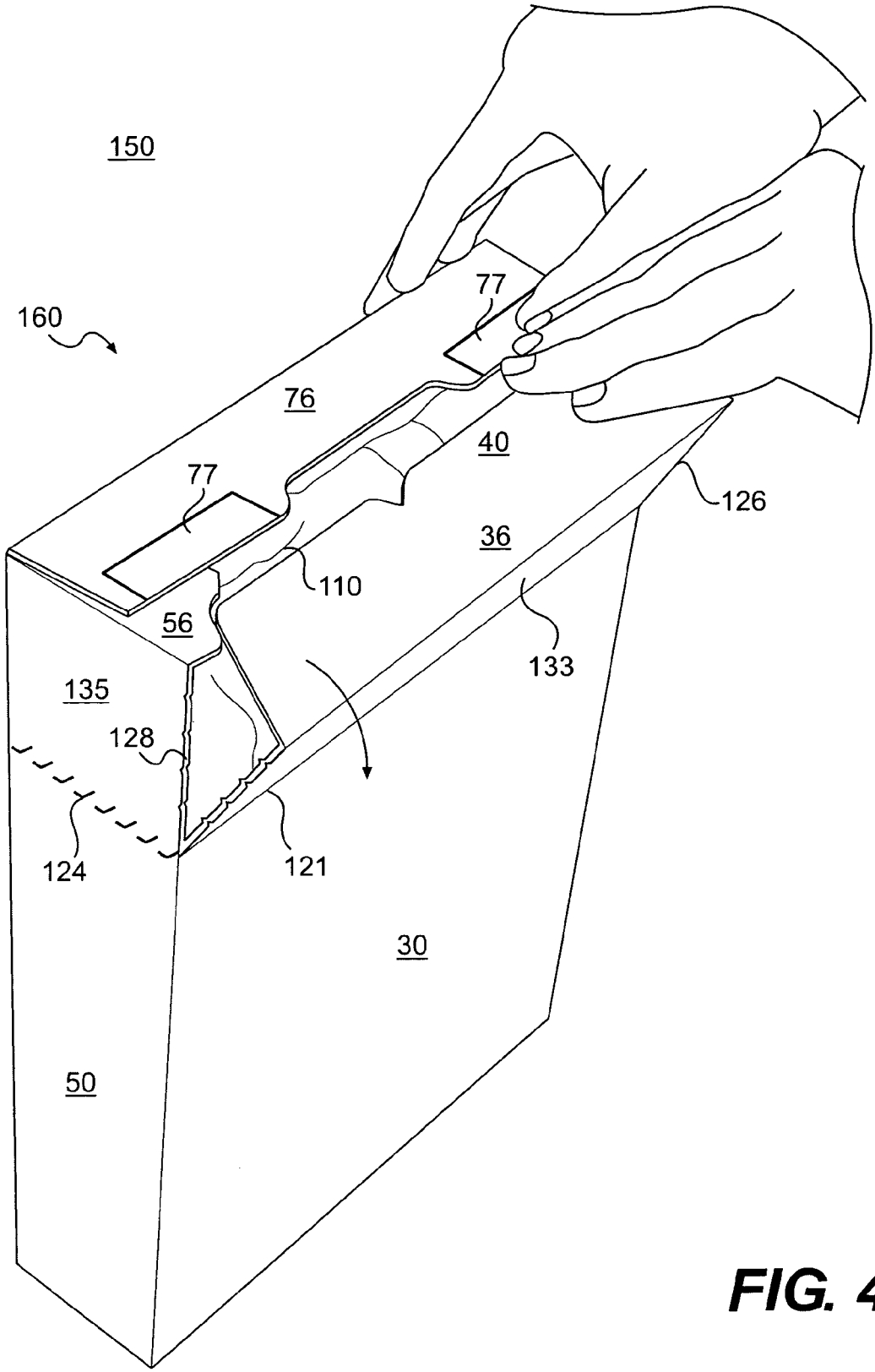
FIGS. 4-8 illustrate opening and reclosure of the reclosable lid of the first carton embodiment.

FIGS. 4-8 illustrate opening and reclosure of the reclosable lid 160. Referring to FIG. 4, the top panel 170 may be opened by separating the top panel 170 at the first and second side top flaps 36, 76. The side top flaps 36, 76 may be separated, for example, by pushing inwardly on the top panel 170, or pulling up on the first side top flap 36 at the tab 40. The first side top flap 36 can then be pulled away from the second side top flap 76 and from the first and second end top flaps 16, 56, if adhered thereto. The carton 150 is further torn along the vertical corner tear lines 126, 128 so that the first side lid panel 133 is separated from the first and second end lid panels 131, 135 and pivoted in the direction of the arrow.

Figure 5:
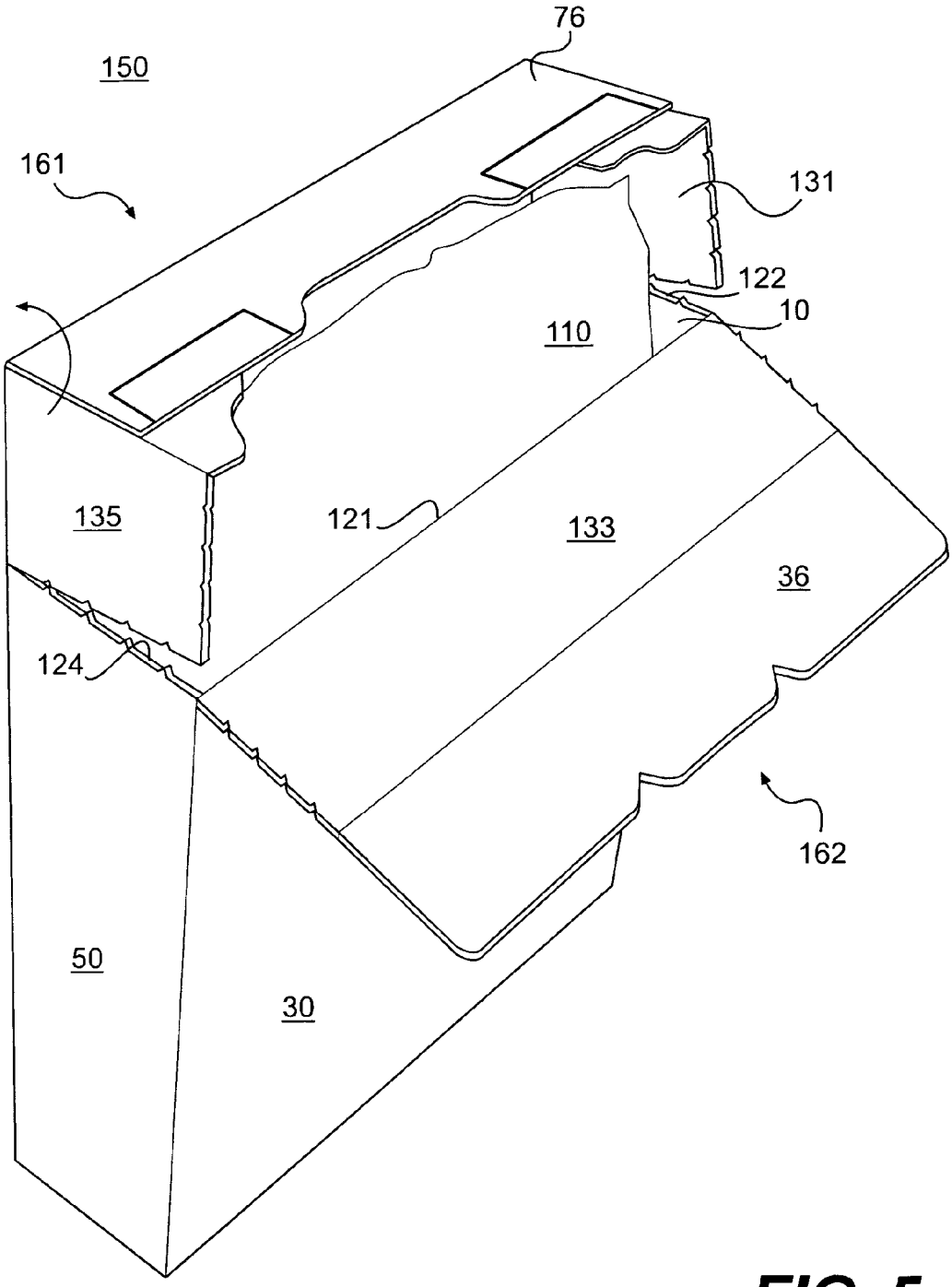

Referring to FIG. 5, the first side lid panel 133 is further pivoted at the longitudinal fold line 121 outwardly and downwardly toward the remaining bottom section of the first side panel 30. The lid panels 131, 135, 137 and the top flaps 16, 56, 76 form a first section 161 of the reclosable lid 160. The first side lid panel 133 and the first side top flap 36 form a second section 162 of the reclosable lid 160. The first and second end lid panels 131, 135 are separated from the remainder of the first and second end panels 10, 50 at the tear lines 122, 124, respectively, by pivoting the first lid section 161 about the fold line 120 in the direction of the arrow. The carton 150 is now opened. If desired, the top section of the flexible vessel 110 may be breached or otherwise opened at this time and its contents dispensed.

Figure 6:
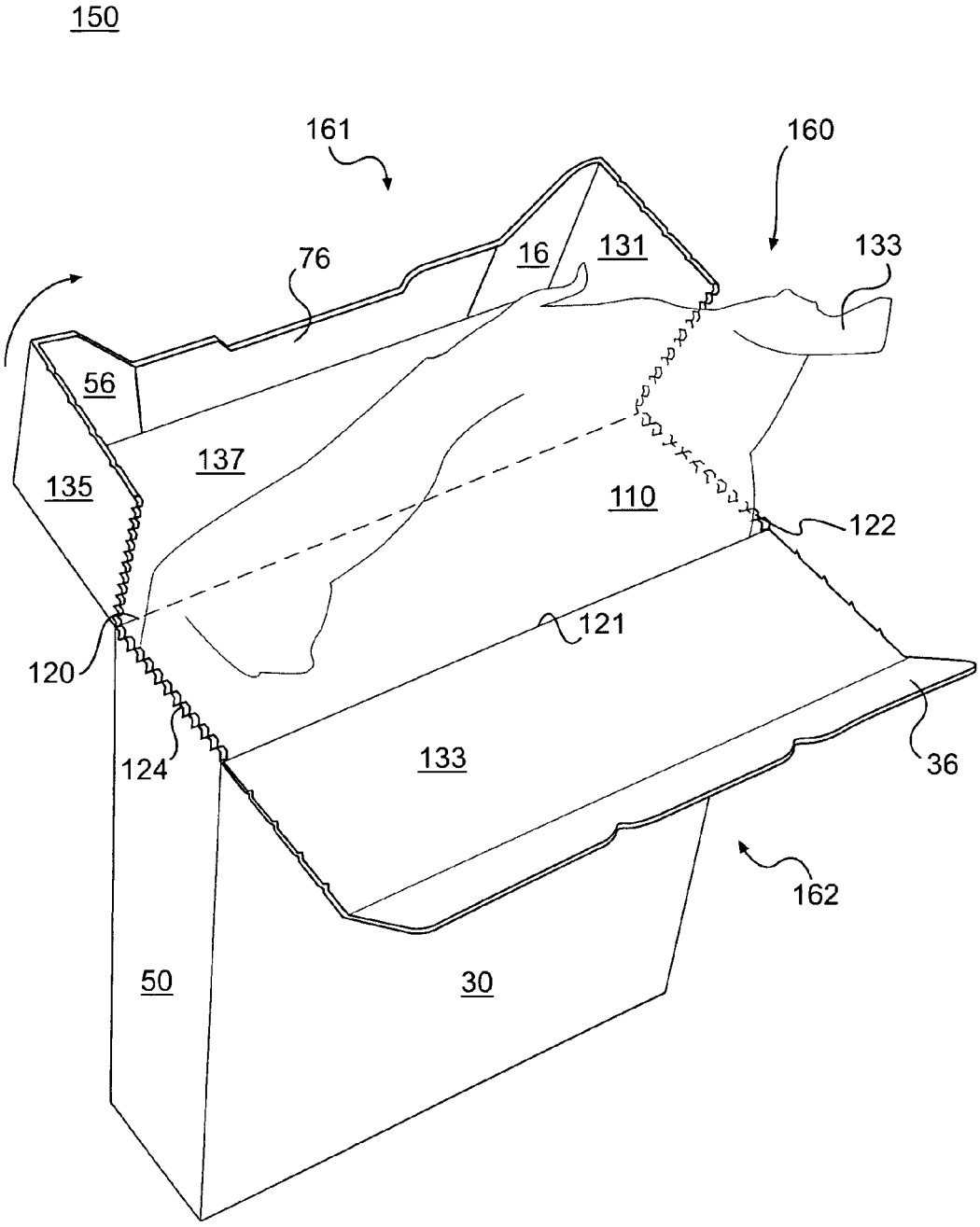
Figure 7:
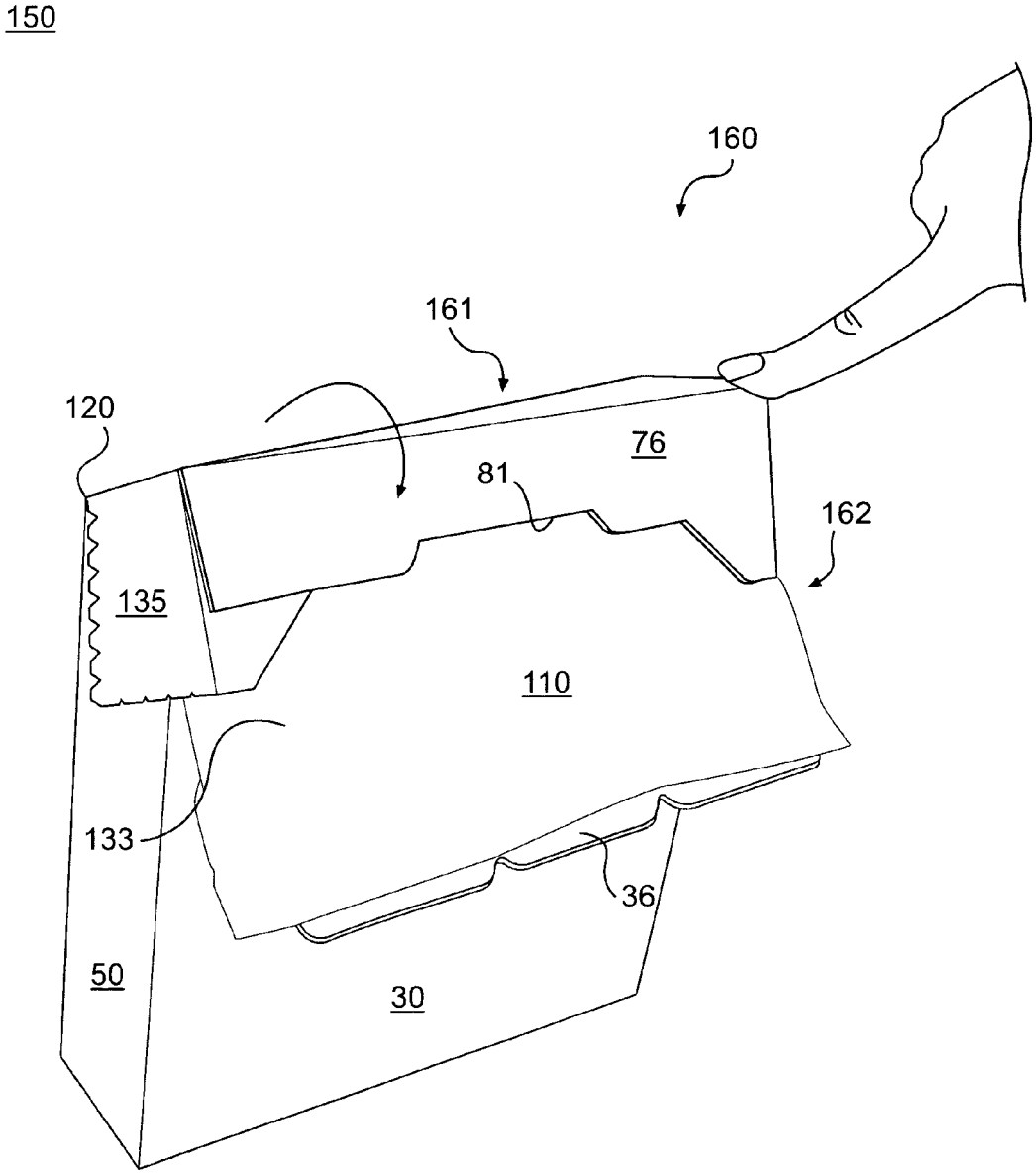
Figure 8:
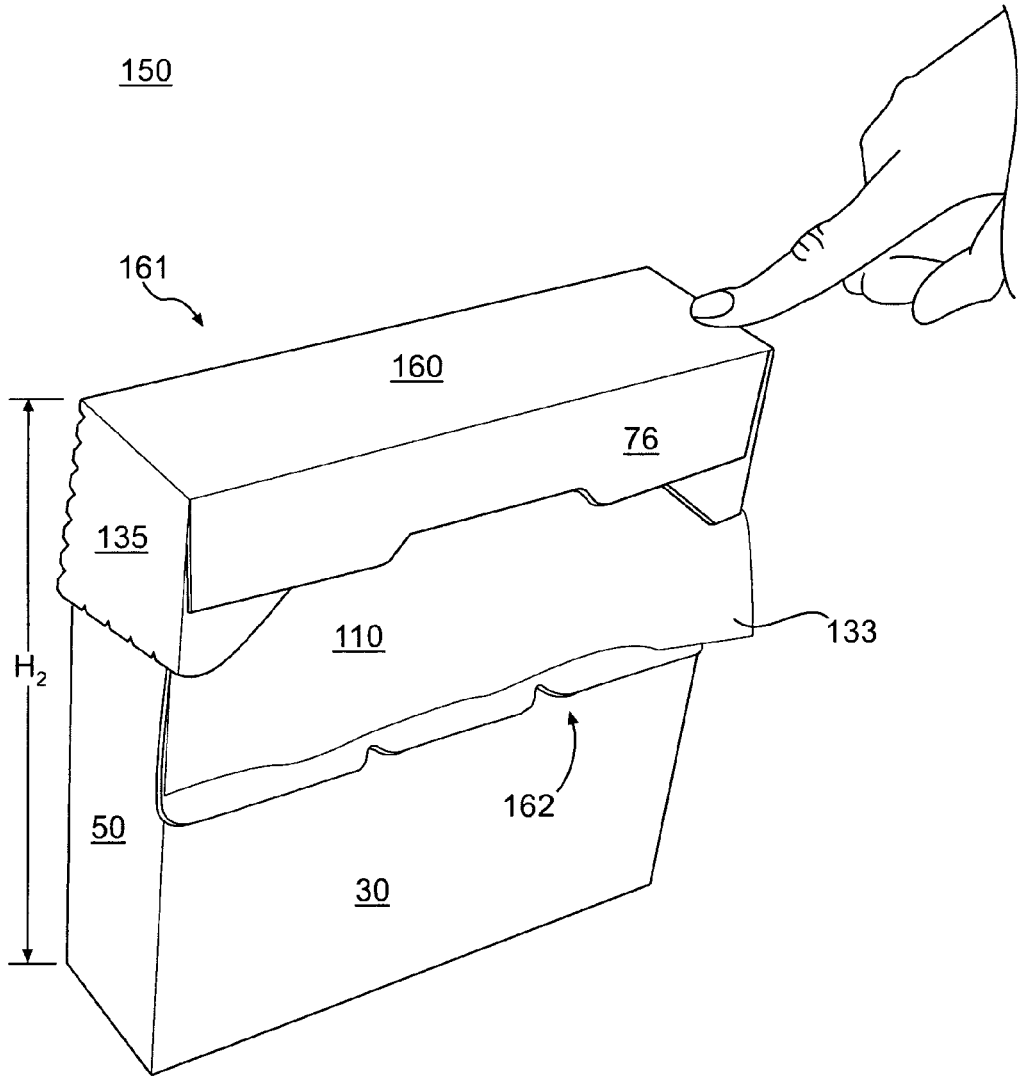

FIGS. 6-8 illustrate reclosure of the reclosable lid 160. Referring to FIGS. 6 and 7, the first section 161 of the lid 160 is pivoted forwardly about the fold line 120 in the direction of the arrow. An upper portion 133 of the bag 110 may be pressed between the first and second lid sections 161, 162 sufficiently tightly so that the bag contents remain securely retained within the bag 110. The second section 162 need not be pivoted forward in a separate operation, and pivoting the first section 161 forward can serve to also pivot the second section 162 and to wedge the bag 110 between the two sections 161, 162.

FIG. 8 illustrates the carton 150 in its reclosed state with the upper portion 133 of the bag 110 retained between the first and second lid sections 161, 162. In FIG. 8, the first lid section 161 is rotated essentially 90 degrees with respect to its position in FIGS. 2-5 such that the upper portion 133 of the bag 110 is adjacent to the first side panel 30.

Figure 9:
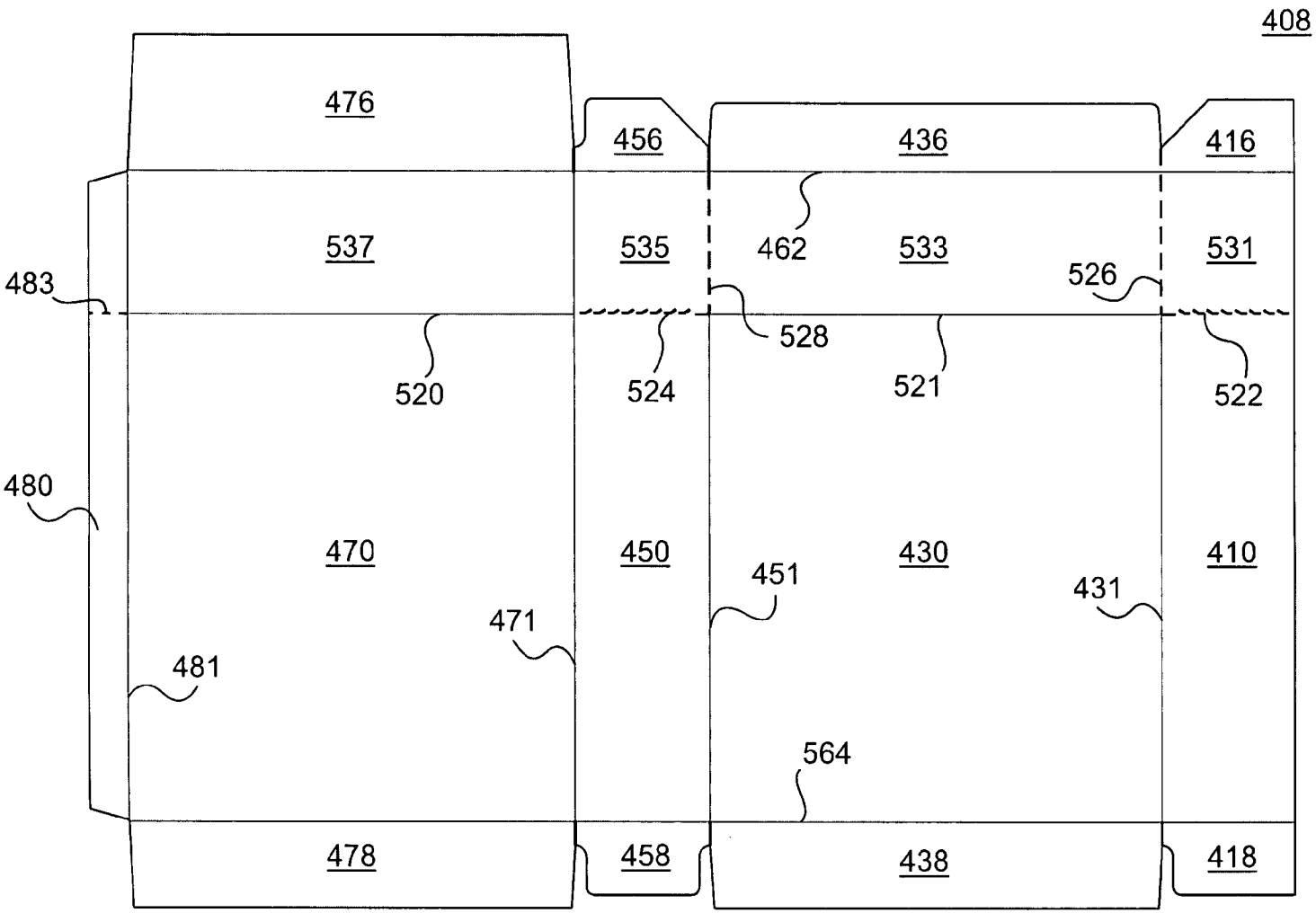
FIG. 9 is a plan view of a blank used to form a carton having a reclosable lid according to a second embodiment of the invention.
Figure 10:
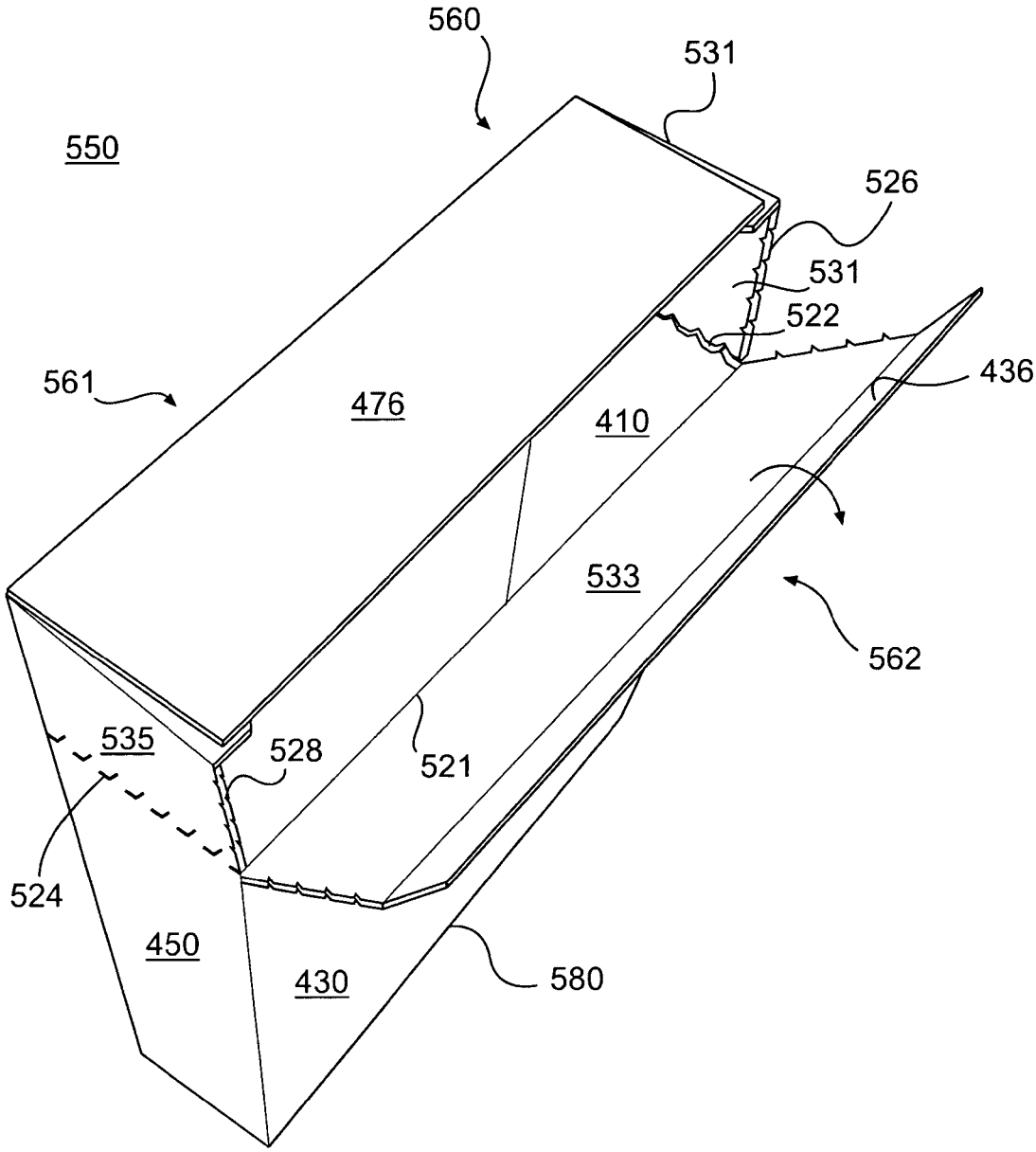
FIGS. 10 and 11 illustrate opening and reclosure of the reclosable lid of the second carton embodiment.
Figure 11:
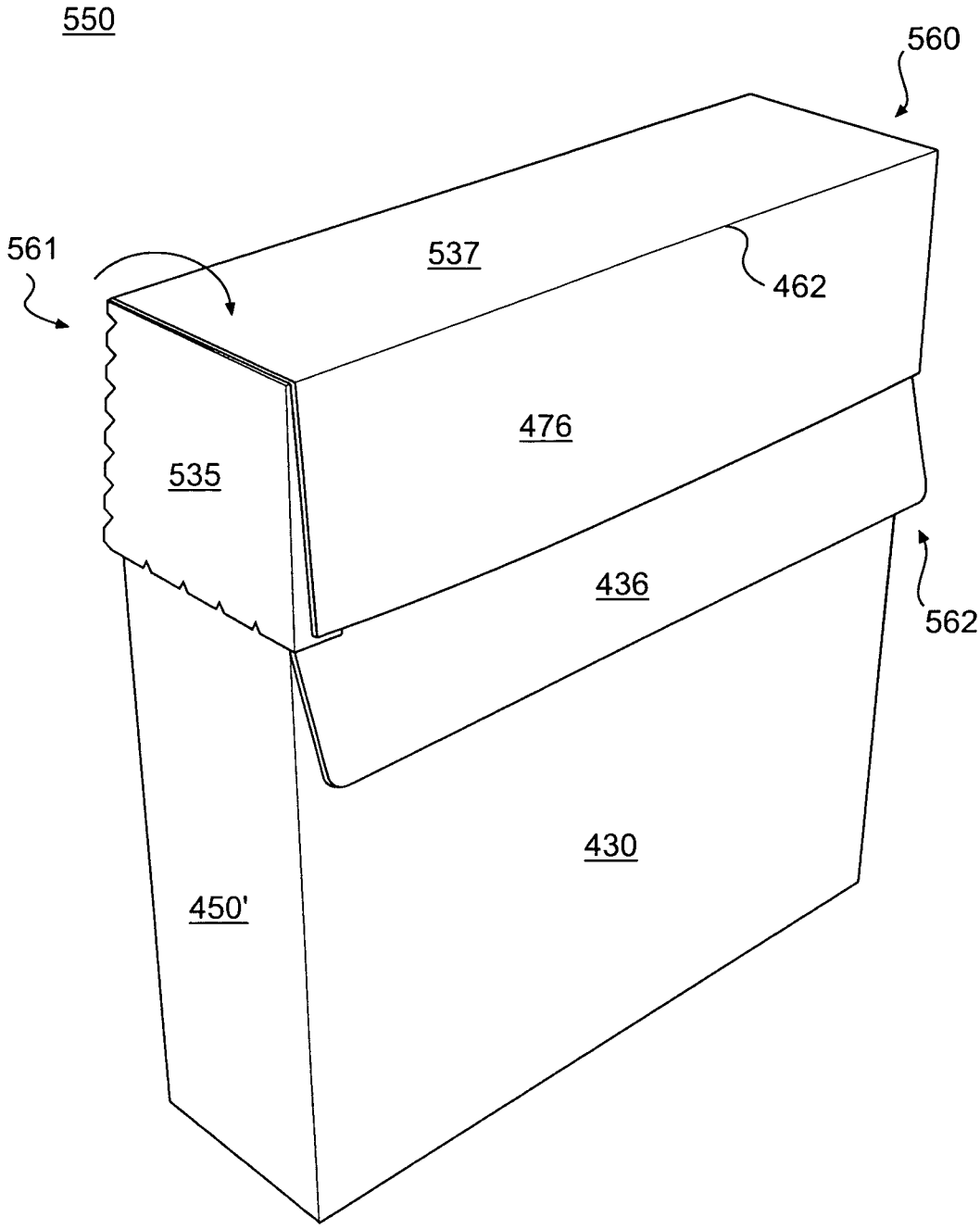

After reclosure, the carton 150 has a height $H_2$. The height $H_2$ after reclosure is reduced from the height $H_1$ of the unopened carton 150 illustrated in FIG. 2 by approximately by the height of the lid panels 131, 133, 135, 137. The reclosed carton 150 therefore occupies less volume than the unopened carton 150. The height $H_2$ can be, for example, less than 90% of the original, unopened carton height $H_1$. In other embodiments, the reclosed height $H_2$ can be less than 80% of the original carton height FIG. 9 is a plan view of a first, exterior side of a blank 408 used to form a carton 550 (illustrated in FIGS. 10 and 11) having a reclosable lid 560 according to a second embodiment of the invention. The blank 408 can be substantially similar to the blank 8 illustrated in FIG. 1. In FIGS. 9-11, certain similar elements to those of FIGS. 1-8 have similar reference numbers, with the reference numbers in FIGS. 9-11 being preceded by a "4" or a "5". The blank 408 differs from the blank 8 in one aspect in that the second side top flap 476 is longer than the first side top flap 436, and extends across substantially the entirety of the top panel of the erected carton 550. Also, the blank 408 does not include a recess in the second side top flap 476 or a tab in the first side top flap 436.

The blank 408 can be erected into a carton in manner similar to the exemplary method discussed above for erecting the carton 150. To close the top of the carton 550, however, the first and second end top flaps 416, 456 are folded inwardly, followed by the second side top flap 476, which is adhered to the exterior sides of the end top flaps 416, 456. The first side top flap 436 is then folded about the fold line 462 and adhered to the exterior side of the second side top flap 476. If desired, a bag (not shown) or other suitable flexible vessel filled with dispensable product may be inserted in the carton 550 in a conventional manner at any time before closing the top and bottom of the carton.

FIG. 10 illustrates the carton 550 being opened. The carton 550 is opened by pulling the first side top flap 436 away from the second side top flap 476 and tearing the lid 560 along the vertical corner tear lines 526, 528. The first side lid panel 533 is thereby separated from the side lid panels 531, 535. The second section 562 of the lid 560 is then pivoted forward in the direction of the arrow. The first section 561 is pivoted back about the fold line 520 (shown in FIG. 9) so that the first section 561 separates from the first and second side panels 410, 450 at the tear lines 522, 524, respectively.

FIG. 11 illustrates the carton 550 in its reclosed state. The carton 550 is reclosed by pivoting the first section 561 forwardly about the fold line 520 so that it closes an open top end of the carton 550 and abuts the second section 562. In this position, the first section 561 is pivoted essentially 90 degrees with respect to its position in FIG. 10 so that the second side top flap 476 is adjacent to the first side panel 430. If a bag were present within the carton, an upper portion of the bag could be pressed between the first and second sections 561, 562 to close the bag. The relatively large second side top flap 476 provides for secure closure of the lid 560. The large surface area of the second side top flap 476 may also be used to display product logos other information at the first side of the carton after reclosure.

Figure 12:
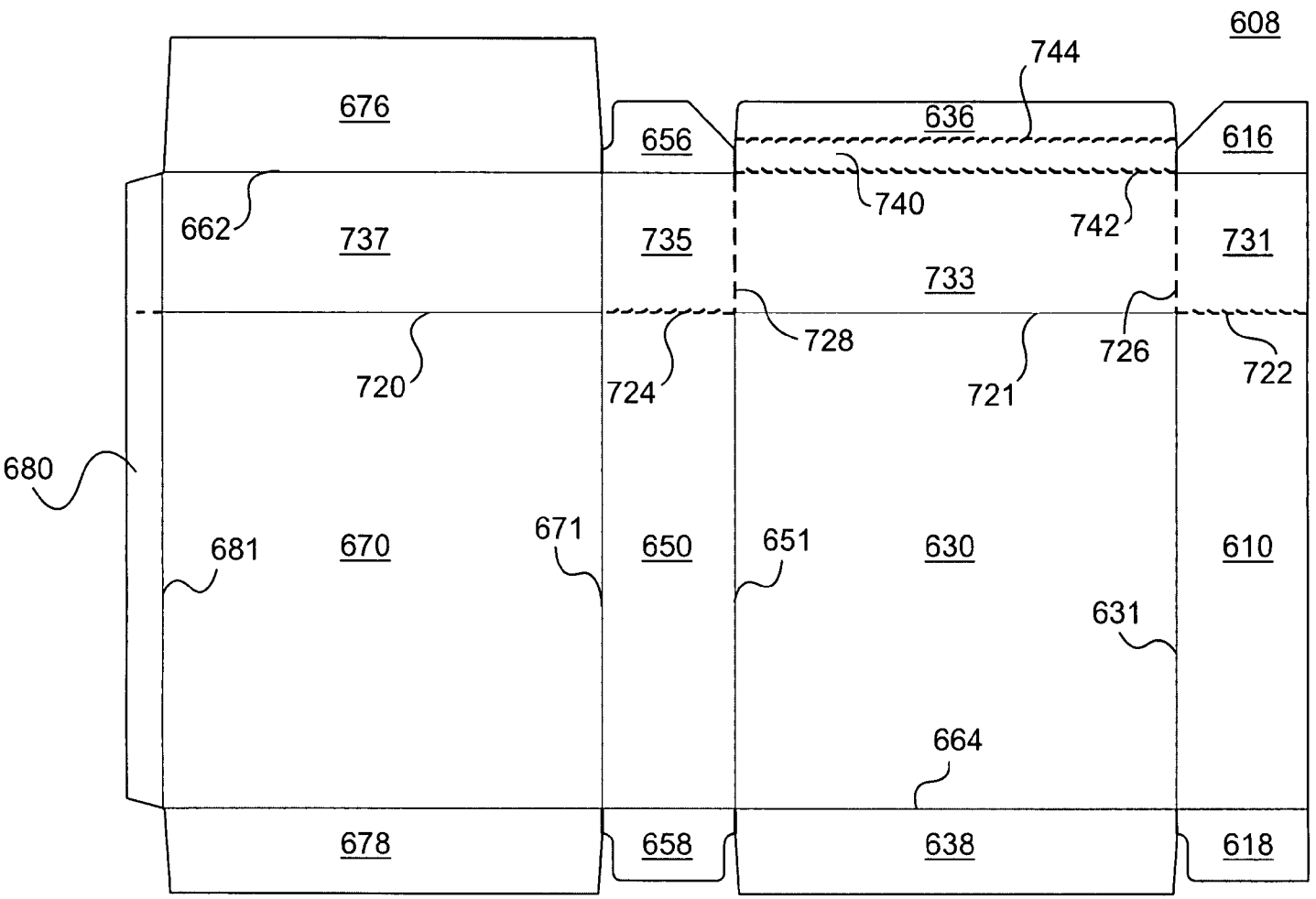
FIG. 12 is a plan view of a blank used to form a carton having a reclosable lid according to a third embodiment of the invention.

FIG. 12 is a plan view of a first, exterior side of a blank 608 used to form a carton 750 (illustrated in FIG. 13) having a reclosable lid 760 according to a third embodiment of the invention. The blank 608 can be substantially similar to the blanks 8 and 208 discussed above. In FIGS. 12-15, certain elements that are similar to those of FIGS. 1-8 have similar reference numbers, with the reference numbers in FIGS. 12-15 being preceded by a "6" or a "7". The blank 608 differs from the blank 8 in one aspect in that the second side top flap 676 is longer than the first side top flap 636, and extends across substantially the entirety of the top panel of the erected carton 750. The blank 608 also includes a tear strip 740 extending through the first side top panel 636 that can be used to initiate opening of the carton 750. The tear strip 740 is defined by spaced longitudinally extending tear lines 742, 744 formed in the first side top flap 636.

The blank 608 can be erected into a carton in manner similar to the exemplary method discussed above for erecting the carton 150. To close the top of the carton 750, however, the first and second end top flaps 616, 656 are folded inwardly, followed by the second side top flap 676, which is adhered to exterior surfaces of the end top flaps 616, 656. The first side top flap 636 is then adhered to the exterior side of the second side top flap 676. In order to ensure ease of removal of the tear strip 740, the tear strip 740 may remain unadhered to the top flaps 616, 656, 676, or, if desired, only lightly adhered thereto. A bag (not shown) or other suitable flexible vessel filled with dispensable product may be inserted in the carton 750 in a conventional manner at any time before closing the top and bottom of the carton.

Figure 13:
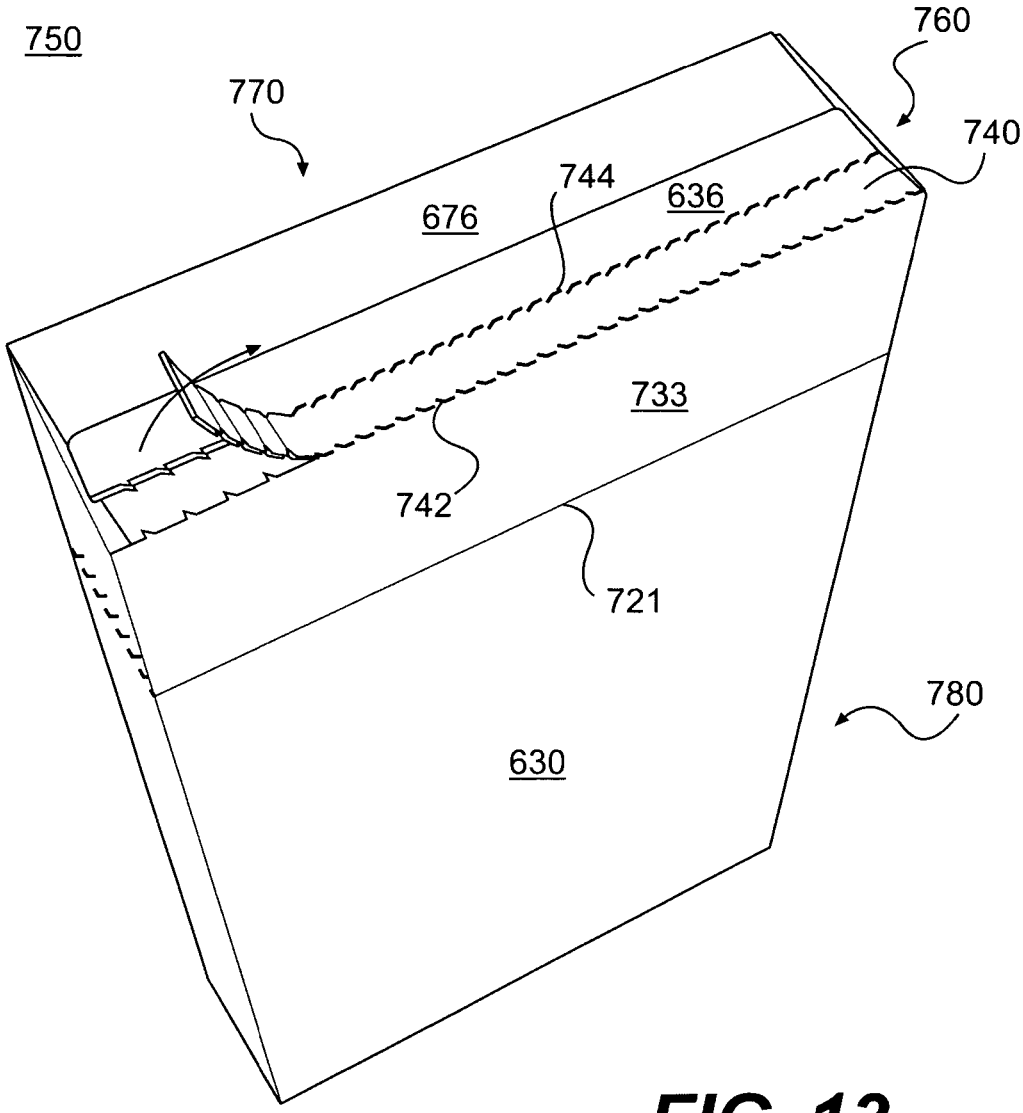
FIGS. 13-15 illustrate opening and reclosure of the reclosable lid of the third carton embodiment.
Figure 14:
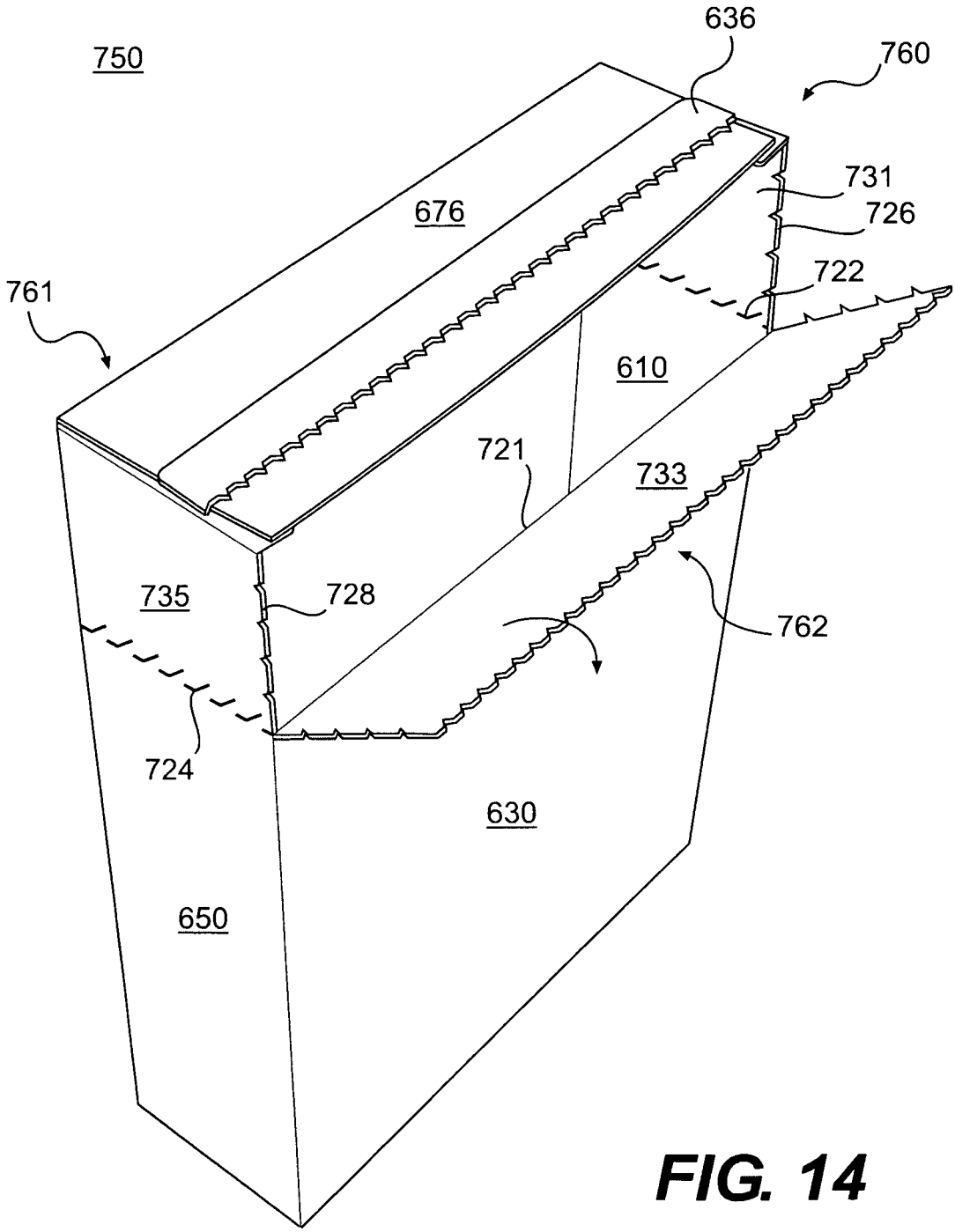

FIGS. 13 and 14 illustrate the carton 750 being opened. Referring to FIG. 13, the carton 750 is opened by pulling the tear strip 740 upwardly so that it tears along the spaced tear lines 742, 744. Referring to FIG. 14, the first side lid panel 733, corresponding to a second lid section 762, is then separated from the side lid panels 731, 735 at the vertical corner tear lines 726, 728, respectively, and pivoted forward in the direction of the arrow. The first section 761 is pivoted back about the fold line 720 so that the first lid section 761 separates from the first and second side panels 610, 650 at the tear lines 722, 724, respectively.

Figure 15:
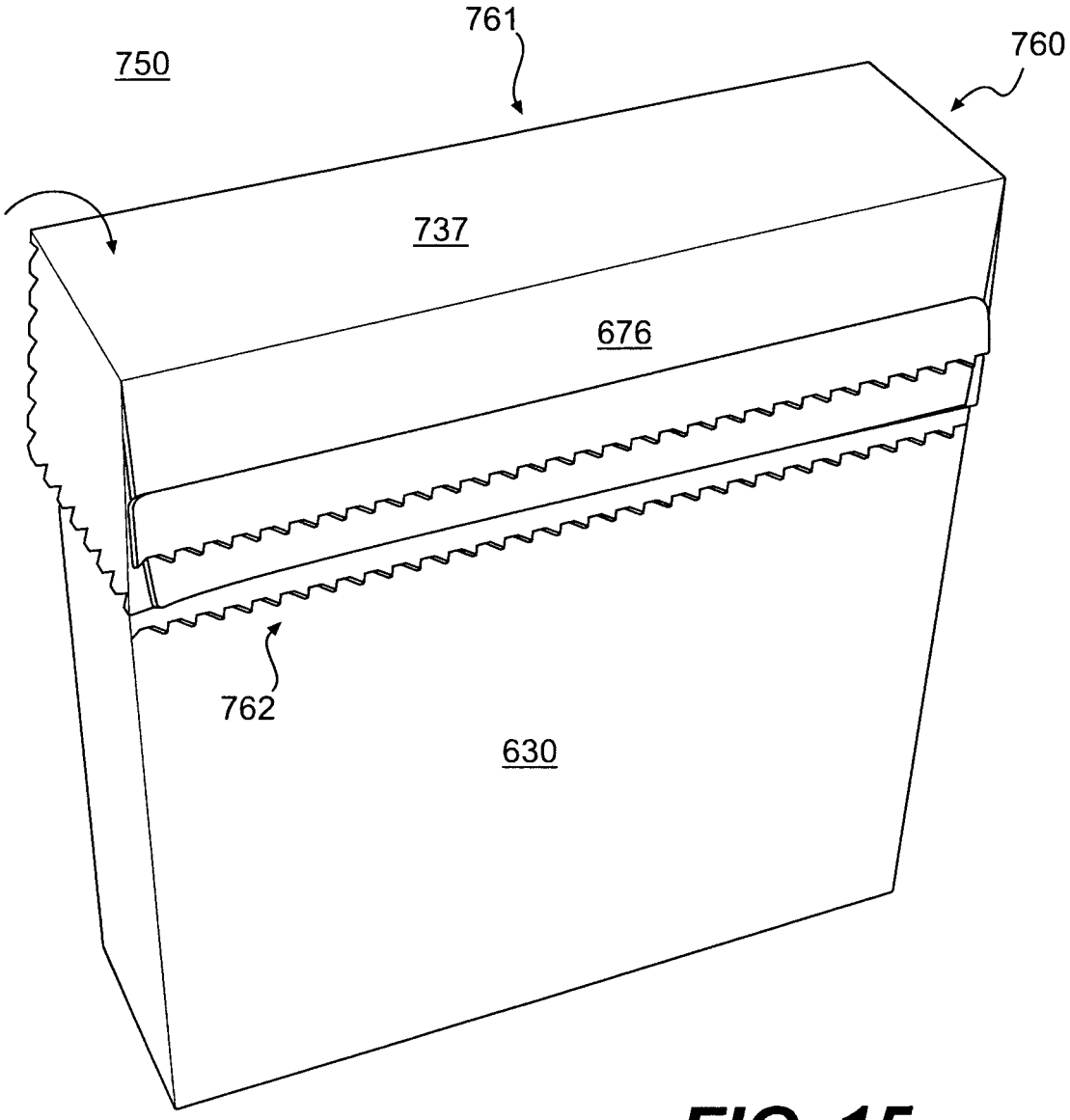

FIG. 15 illustrates the carton 750 in its reclosed state. The carton 750 is reclosed by pivoting the first lid section 761 forwardly about the fold line 720 so that it closes an open top end of the carton 750 and abuts the first section 761. In this position, the first section 761 is pivoted essentially 90 degrees with respect to its position in FIG. 14 so that the second side top flap 676 is adjacent to the first side panel 630. If a bag were present within the carton 750, an upper portion of the bag could be pressed between the first and second sections 761, 762 to close the bag.

In the above embodiments, the second sections of the lids may optionally be removed upon opening of the cartons. In such an arrangement, the first sections of the lids may be configured such that pivoting the first section forward secures the bag contents between the first lid section and the remainder of the first side panel. Cuts or other perforations may be placed in the fold lines at the first side lid panel to facilitate removal of the second lid sections.

According to the above-described embodiments, the reclosable lids provide easy access to the carton contents. The reclosable lids may be easily opened and repeatedly reclosed. When closed, the lids can secure the upper portion of a bag or other flexible vessel such that the carton contents remain securely retained in the bag. Also according to the above embodiments, the cartons occupy a reduced volume after opening and reclosing the lids. The carton heights may be reduced by, for example, 10%, 20% or more.

In the exemplary embodiments discussed above, the blanks may be formed from clay coated newsprint (CCN). In general, the blanks may be constructed of paperboard, having a caliper of at least about 12, for example, so that they are heavier and more rigid than ordinary paper. The blanks, and thus the cartons, can also be constructed of other materials having properties suitable for enabling the carton to function at least generally as described above. Solid unbleached sulfate (SUS) board, for example, may be used to form cartons in accordance with the principles of the present invention.

The interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks, or laminated to or coated with one or more sheet-like materials at selected panels or panel sections.

In accordance with the exemplary embodiment of the present invention, a fold line can be any substantially linear, although not necessarily straight, line of disruption in the blank that facilitates folding therealong during ordinary use of a carton. More specifically, but not for the purpose of narrowing the scope of the present invention, fold lines include: score lines; crease lines; a cut or a series of cuts that extend partially into and/or completely through a blank along a desired line of weakness; and various combinations of these features.

For purposes of the description presented herein, the term "line of disruption" can be used to generally refer to cut lines, score lines, tear lines, crease lines, perforations, fold lines, combinations thereof, or other disruptions formed in a blank. A "breachable" line of disruption as disclosed in this specification refers to a line of disruption that is intended to be breached or otherwise torn during ordinary use of a carton.

A tear line can be any breachable line of disruption that facilitates tearing therealong. Specifically, but not for the purpose of narrowing the scope of the present invention, tear lines include: a cut that extends partially into the material along the desired line of weakness, and/or a series of cuts that extend partially into and/or completely through the material along the desired line of weakness, or various combinations of these features. As a more specific example, one type of tear line is in the form of a series of cuts that extend completely through the material, with adjacent cuts being spaced apart slightly so that small somewhat bridge-like pieces of the material (e.g., 'nicks') are defined between adjacent cuts. The nicks are broken during tearing along the tear line.

The term "line" as used herein includes not only straight lines, but also other types of lines such as curved, curvilinear or angularly displaced lines.

The above embodiments may be described as having one or panels adhered together by glue. The term "glue" is intended to encompass all manner of adhesives commonly used to secure paperboard carton panels in place.

In the present specification, a "panel" or "flap" need not be flat or otherwise planar. A "panel" or "flap" can, for example, comprise a plurality of interconnected generally flat or planar sections.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A method of opening and closing a carton, comprising:

providing a carton comprising:

a first end panel;

a first side panel;

a second end panel opposite the first end panel;

a second side panel opposite the first side panel;

a bottom panel; and a top panel, wherein a reclosable lid comprises a first section comprising at least a first portion of the top panel, at least a portion of the first end panel, and at least a portion of the second end panel, and a second section comprising at least a second portion of the top panel and at least a portion of the first side panel, the first section is pivotably mounted at the second side panel and the second section is pivotably mounted at the first side panel, wherein a flexible vessel is disposed within the carton;

opening the carton, the opening the carton comprising pivoting the first section and the second section in opposite directions to access the flexible vessel, wherein the pivoting the second section comprises pivoting at least the second portion of the top panel along with the portion of the first side panel; and closing the carton, the closing the carton comprising pivoting the first section so that the first section moves toward the first side panel, wherein pivoting the first section toward the first side panel comprises pressing an upper portion of the flexible vessel between the portion of the top panel of the first section and the portion of the first side panel of the second section.

2. The method of claim 1, wherein pivoting the first section toward the first side panel comprises pivoting the first portion of the top panel of the first section until it is adjacent to the portion of the first side panel of the second section.

3. The method of claim 1, wherein pivoting the first section toward the first side panel comprises pivoting the first section about a fold line in the second side panel.

4. The method of claim 1, wherein opening the carton comprises:

separating a lid portion of the first end panel from a remainder of the first end panel; and separating a lid portion of the second end panel from a remainder of the second end panel.

5. The method of claim 4, wherein opening the carton comprises separating a lid portion of the first side panel from the lid portion of the first end panel.

6. The method of claim 1, wherein the top panel comprises a plurality of end top flaps.

7. The method of claim 1, wherein the carton is substantially parallelepipedal.

8. The method of claim 1, wherein the opening the carton further comprises separating the first portion of the top panel from the second portion of the top panel.

9. The method of claim 1, wherein the portion of the first side panel of the second section of the reclosable lid overlaps a remaining portion of the first side panel after the closing the carton.

10. A substantially parallelepipedal carton, comprising:

a first end panel;

a first side panel;

a second end panel opposite the first end panel;

a second side panel opposite the first side panel;

a bottom panel;

a top panel; and a flexible vessel accommodated within the carton, wherein a reclosable lid comprises a first section comprising at least a first portion of the top panel, at least a portion of the first end panel, and at least a portion of the second end panel, and a second section comprising at least a second portion of the top panel, and at least a portion of the first side panel, the first section is pivotably mounted at the second side panel, and the second section is pivotably mounted at the first side panel, the reclosable lid being positionable between an open position, wherein the first section and the second section are pivoted in opposite directions to access the flexible vessel, and a closed position wherein the first section is pivoted toward the first side panel;

wherein in the open position, the second portion of the top panel is foldably connected to the portion of the first side panel in the first section of the reclosable lid;

wherein in the closed position, an upper portion of the flexible vessel is pressed between the portion of the top panel of the first section and the portion of the first side panel of the second section.

11. The carton of claim 10, wherein the reclosable lid comprises:

a first end lid panel defined in the first end panel; and a second end lid panel defined in the second end panel.

12. The carton of claim 11, wherein the reclosable lid is defined in part by:

a breachable line of disruption extending across a top portion of the first end panel and defining a bottom edge of the first end lid panel; and a breathable line of disruption extending across a top portion of the second end panel and defining a bottom edge of the second end lid panel.

13. The carton of claim 12, wherein the reclosable lid is further defined in part by:

a breathable line of disruption between the first end lid panel and a portion of the first side panel; and a breachable line of disruption between the second end lid panel and a portion of the first side panel.

14. The carton of claim 10, wherein the first section is connected to the second section at at least one tear line.

15. The carton of claim 10, wherein a bottom edge of the first section is defined by a fold line extending across the second side panel.

16. The carton of claim 10, wherein the top panel comprises a plurality of end top flaps.

17. The carton of claim 10, wherein the reclosable lid is positionable to the open position after the first portion of the top panel is separated from the second portion of the top panel.

18. The carton of claim 10, wherein, in the closed position of the reclosable lid, the portion of the first side panel of the second section of the reclosable lid overlaps a remaining portion of the first side panel.

19. A carton blank for forming a carton having a flexible vessel accommodated therein, the blank comprising:

a first end panel;

a first side panel connected to the first end panel at a first transverse fold line;

a second end panel;

a second side panel connected to the second end panel at a second transverse fold line;

at least a first and a second top flap extend along a first marginal area of the blank, wherein the first top flap is foldably connected to the first side panel along a first longitudinal fold line and the second top flap is foldably connected to the second side panel along a second longitudinal fold line;

at least one bottom flap extending along a second marginal area of the blank;

a third longitudinal fold line extending through the second side panel;

a fourth longitudinal fold line extending through the first side panel;

a first tear line extending generally transversely between the first end panel and the first side panel;

a second tear line extending generally transversely between the second end panel and the first side panel; and a reclosable lid of the carton formed from the blank comprises a first section comprising at least a portion of the second top flap, at least a portion of the first end panel, and at least a portion of the second end panel, and a second section comprising at least a portion of the first top flap and at least a portion of the first side panel, the first section being pivotably mounted at the third longitudinal fold line and the second section being pivotably mounted at the fourth longitudinal fold line, the reclosable lid of the carton formed from the blank being positionable between an open position, wherein the first section and the second section are pivoted in opposite directions to access the flexible vessel, and a closed position wherein the first section is pivoted toward the first side panel;

wherein in the open position of the reclosable lid of the carton formed from the blank, the first top flap is foldably connected to the portion of the first side panel along the first longitudinal fold line;

wherein in the closed position, an upper portion of the flexible vessel is pressed between the portion of the top panel of the first section and the portion of the first side panel of the second section.

20. The carton blank of claim 19, further comprising a third tear line extending generally longitudinally through the first end panel and adjacent to the first tear line.

21. The carton blank of claim 20, further comprising a fourth tear line extending generally longitudinally through the second end panel and adjacent to the second tear line.

22. The carton blank of claim 21 wherein the fourth longitudinal fold line extends through the first side panel between the third and fourth tear lines.

23. The carton blank of claim 22, wherein the third and fourth tear lines and the third and fourth longitudinal fold lines are substantially collinear.

24. The carton blank of claim 19, wherein the reclosable lid of the carton formed from the blank is for being positionable to the open position after the first top flap is separated from the second top flap in the carton formed from the blank.

25. The carton blank of claim 19, wherein, in the closed position of the reclosable lid in the carton formed from the blank, the portion of the first side panel of the second section of the reclosable lid overlaps a remaining portion of the first side panel.

* * * * *